US005277606A

United States Patent [19]

Giroux et al.

[11] Patent Number: 5,277,606

[45] Date of Patent: * Jan. 11, 1994

[54] FULLY PROGRAMMABLE CONNECTOR

[75] Inventors: David C. Giroux, Gorham, Me.; David W. Mendenhall, Greenville, R.I.

[73] Assignee: Augat Inc., Mansfield, Mass.

[ * ] Notice: The portion of the term of this patent subsequent to Dec. 10, 2008 has been disclaimed.

[21] Appl. No.: 5,753

[22] Filed: Jan. 19, 1993

Related U.S. Application Data

[63] Continuation-in-part of Ser. No. 953,652, Sep. 29, 1992, which is a continuation-in-part of Ser. No. 830,363, Jan. 31, 1992.

[51] Int. Cl.[5] ..... H01R 31/08

[52] U.S. Cl. ..... 439/188; 439/513; 439/43

[58] Field of Search ..... 200/51.09, 51.1; 439/43, 188, 510-573, 439/636

[56] References Cited

U.S. PATENT DOCUMENTS

| | | | |
|---|---|---|---|
| 2,312,002 | 2/1943 | Schmitt | 439/188 |
| 3,786,402 | 1/1974 | Horecky | 439/872 |
| 4,070,557 | 1/1978 | Ostapovitch | 200/51.1 |
| 4,152,041 | 5/1979 | Hollyday et al. | 439/188 |
| 4,220,393 | 9/1980 | Ammon et al. | 439/682 |
| 4,342,493 | 8/1982 | Bennett et al. | 439/689 |
| 4,352,534 | 10/1982 | Johnson | 439/510 |
| 4,466,689 | 8/1984 | Davis et al. | 439/801 |
| 4,516,817 | 5/1985 | Deters | 439/513 |
| 4,588,240 | 5/1986 | Ruehl et al. | 439/513 |
| 4,607,899 | 8/1986 | Romine et al. | 439/512 |
| 4,778,396 | 10/1988 | Spooren | 439/682 |
| 4,795,002 | 1/1989 | Burgei et al. | 188/2 D |
| 4,909,744 | 3/1990 | Muto | 439/65 |
| 5,052,936 | 10/1991 | Biechler et al. | 439/60 |
| 5,071,362 | 12/1991 | Martens et al. | 439/188 |

*Primary Examiner*—Gary F. Paumen

*Attorney, Agent, or Firm*—Weingarten, Schurgin, Gagnebin & Hayes

[57] ABSTRACT

A fully programmable connector is provided in which selected ones of the connector contacts can be electrically shorted within the same connector housing body. The housing body includes a plurality of identical cells each containing an electrical contact and each configured to contain a shorting clip. One or more shorting clips are retained in intended cells of the housing body to short circuit the corresponding contacts.

11 Claims, 12 Drawing Sheets

FULLY PROGRAMMABLE CONNECTOR

CROSS-REFERENCE TO RELATED APPLICATION

This application is a continuation-in-part of commonly-assigned U.S. patent application Ser. No. 07/953,652, filed Sep. 29, 1992 entitled FULLY PROGRAMMABLE CONNECTOR, which is a continuation-in-part of commonly assigned U.S. patent application Ser. No. 07/830,363, filed Jan. 31, 1992, entitled FULLY PROGRAMMABLE DIN CONNECTOR.

FIELD OF THE INVENTION

This invention is directed to the field of electrical interconnection devices, and more particularly, to fully programmable connectors.

BACKGROUND OF THE INVENTION

So-called DIN connectors include a housing body supporting plural contacts typically either in a three (3) by thirty-two (32) array or in a three (3) by forty (40) array. Each contact of the array of contacts of such DIN connectors typically has a pin rearwardly extending beyond the housing body and a socket embedded therewithin and frontwardly accessible through a corresponding opening provided therefor through the connector top face.

In many applications, such as in some computer network interfaces, there is a need to electrically connect (short) two or more contacts of such connectors pairwise whenever both of their corresponding sockets are free from pins but to electrically disconnect the same whenever either of their corresponding sockets has a pin of a mating connector inserted thereinto. Heretofore, to solve this problem, each connector was specially configured to receive one or more shorting clips at those specific locations of the array that corresponded to the one or more pairs of contacts to be selectively shorted. The shorting clips, embedded within the housing body at those specific locations, electrically-shorted the selected contacts together. But for each configuration of different contacts selected to be shorted, another specially configured housing body having one or more shorting clip receiving cavities conforming to each pattern of contact pairs needed to =manufactured and stockpiled, with consequent materials and labor wastage, and undesirable stockpiling of inventory.

SUMMARY OF THE INVENTION

It is accordingly the principal object of the present invention to provide a fully programmable DIN or other connector that enables the connector to be programmed to electrically short selected ones of the connector contacts thereby eliminating the prior art need to manufacture a different connector for each different pattern of contacts to be shorted, and eliminating the need to maintain an inventory of different connectors for each different pattern of contacts selected. In accord with this object, the disclosed fully programmable connector of the present invention includes a housing body having opposing top and bottom faces between which a plurality of identical, selectively programmable cells are arrayed in a selected DIN or other configuration. Each of the cells contain a cavity configured to receive a shorting clip, and a cavity configured to receive a contact. A plurality of contacts are retained respectively in the associated cavities of the housing body. The contacts preferably have an integral socket portion and an integral pin portion. In one embodiment, the contacts are bottom loaded in the housing body, with the socket portions confronting respective opening on one face of the housing body, and the pin portions outwardly extending from an opposite face of the housing body. One or more shorting clips are retained in intended ones of the associated respective cavities of the housing body. In one embodiment, the shorting clips are top loaded in the housing body, and a housing cover is mated to the top face of the body.

BRIEF DESCRIPTION OF THE DRAWINGS

Other objects, aspects and features of the instant invention will become apparent as the invention becomes better understood by referring to the following detailed description of the preferred embodiment thereof, and to the drawings, wherein.

DETAILED DESCRIPTION OF THE PREFERRED EMBODIMENTS

Figure 1:
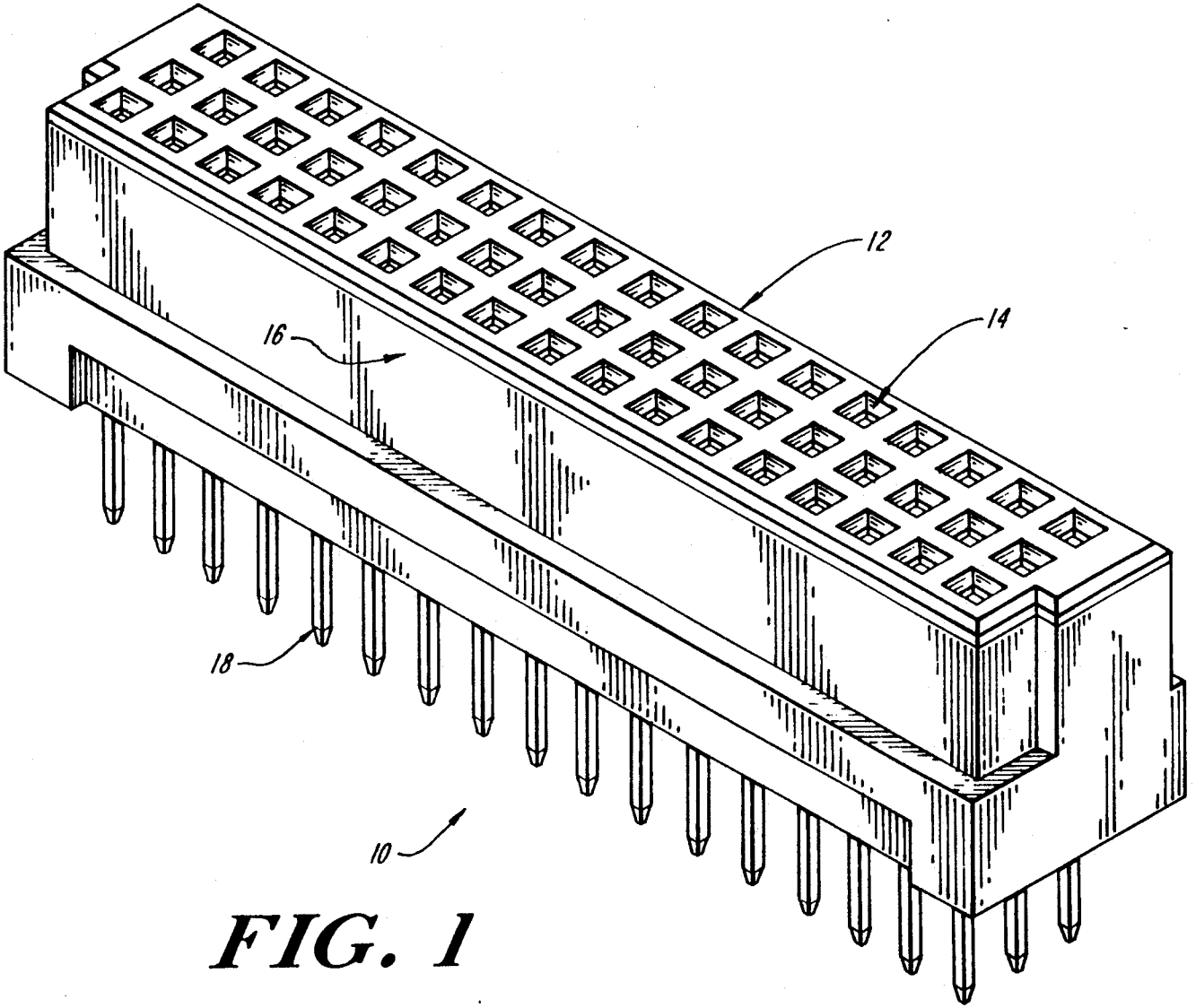
FIG. 1 is a perspective view of one embodiment of a DIN connector constructed in accord with the present invention.

Referring now to FIG. 1, one embodiment of the DIN connector of the invention is generally designated at 10. The connector 10 includes a separable cover member generally designated 12 having an array of openings generally designated 14 thereinthrough, a fully programmable housing body generally designated 16 and a plurality of bottom loadable contacts generally designated 18. The openings 14 of the cover 12 and the contacts 1 bottom loadable into the housing body 16 define an exemplary three (3) by seventeen (17) DIN connector array, although, as will be appreciated by those skilled in the art, other DIN array and other array configurations than that specifically illustrated are contemplated.

Figure 2:
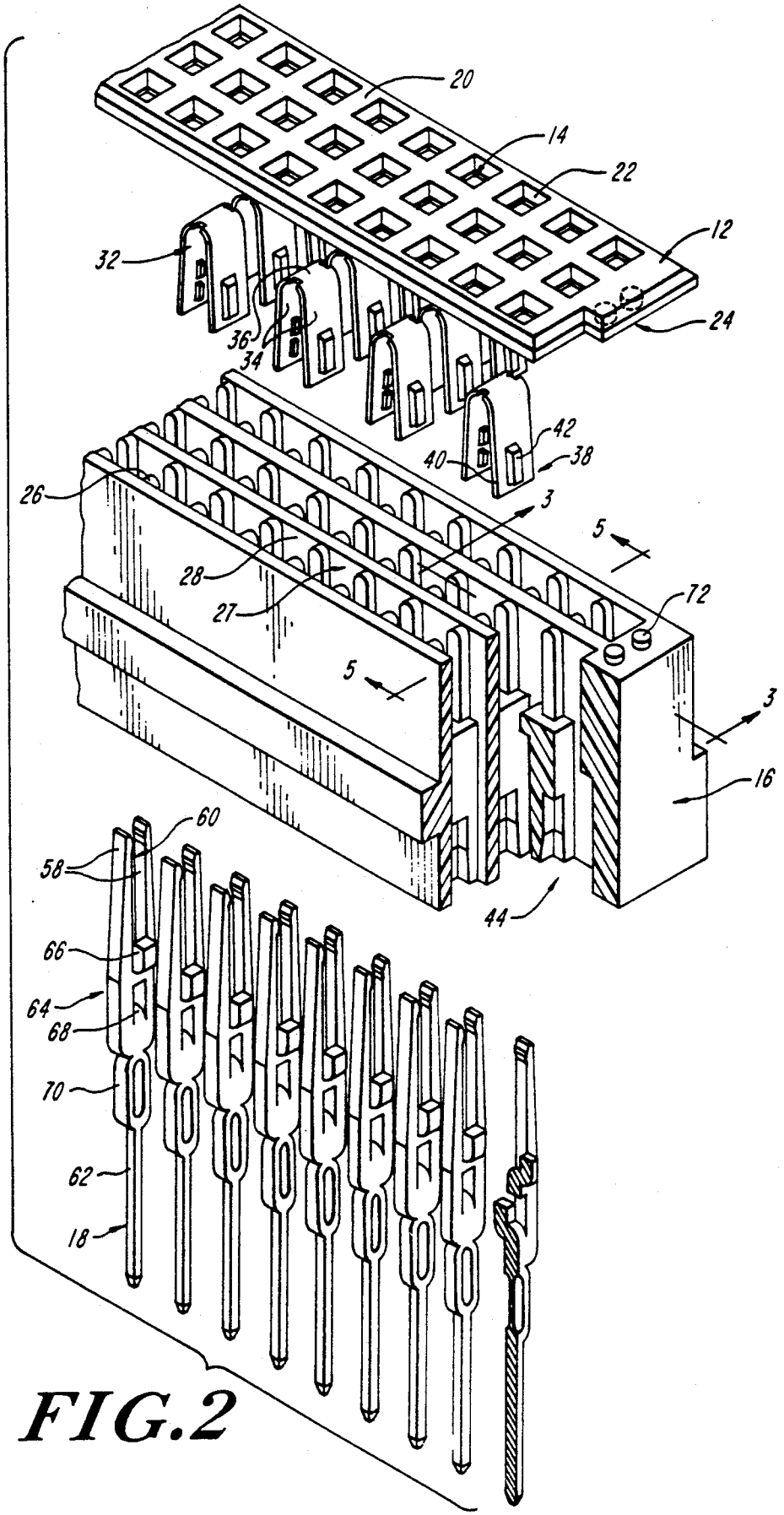
FIG. 2 is an exploded perspective view of a portion of the DIN connector constructed in accord with the present invention.

Referring now to FIG. 2, the cover 12 is constituted as a generally planar top member 20 through which the openings 14 are integrally formed in such a way that outwardly facing beveled walls 22 surround each of the openings 14 to facilitate the entry thereinto of the pins of a mating connector, not shown. One or more walls defining one or more post receiving apertures illustrated generally at 24 are provided at the longitudinal ends of the cover 12. The one or more apertures 24 cooperate with posts to be described to secure the cover 12 to the fully programmable housing body 16.

Figure 3:
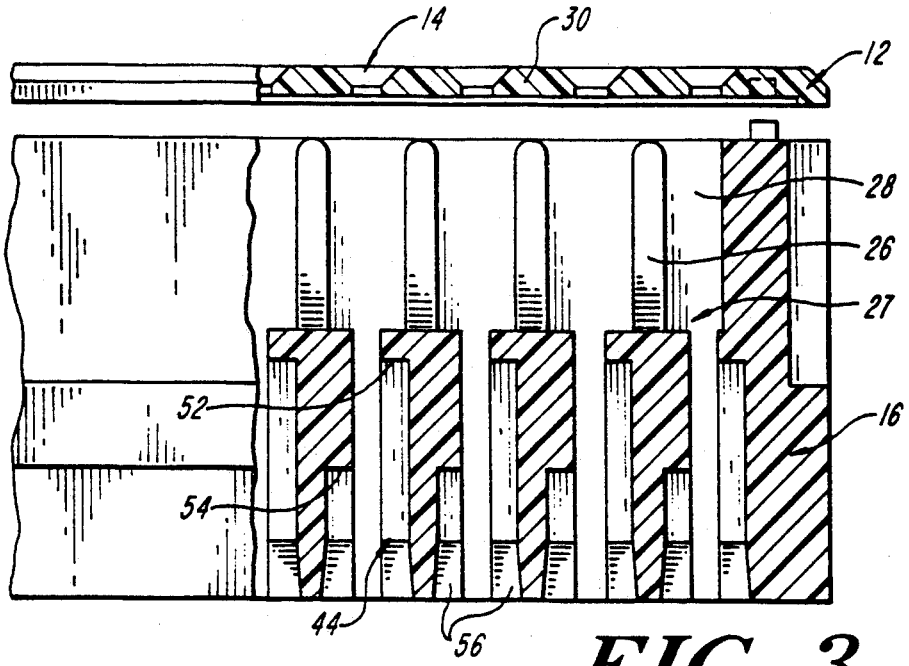
FIG. 3 is a longitudinal section along the lines 3—3 of FIG. 2 shown with the cover exploded from the body and with the cells empty of shorting clips and contacts.
Figure 4:
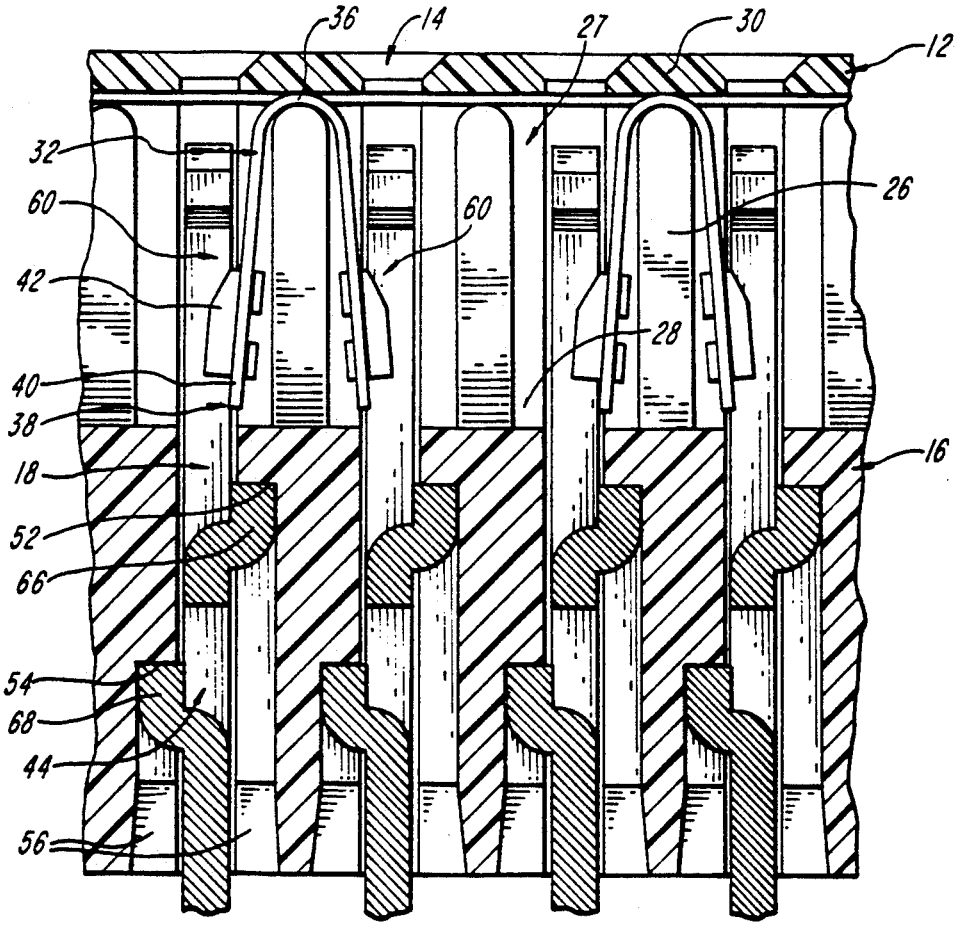
FIG. 4 likewise is a partial longitudinal section but shown with the cover in bonded relation to the housing body and with shorting clips selectively loaded into and with contacts loaded into the fully programmable cells of the housing body.

In accord with the present invention, one embodiment of the fully programmable housing body 16 is constructed of a plurality of identical cells that perform two functions. The first is to receive from the top face thereof one or more shorting clips and to support the same within the housing body 16 in position to electrically short- circuit any selected one or more pairs of longitudinally adjacent contacts 18. The second is to receive 16 through the bottom face thereof the contacts 18 and to retain the same therewithin in such manner both that each is aligned with another opening 14 of the cover 12 and that adjacent pairs thereof are in position to be electrically shorted when such pairs have been selected to be electrically shorted by corresponding one or more shorting clips. In the presently preferred embodiment, confronting pairs of vertically extending, rounded-top shorting clip supporting ribs 26 are formed in longitudinally-spaced relation along transversely-spaced, longitudinally-extending and generally-planar vertical walls 28 of the fully programmable housing body 16 to implement the function of receiving from the top and supporting shorting clips in position to electrically-short on or more pairs of longitudinally-adjacent contacts 18. As best seen in FIGS. 3 and 4, the ribs 26 on the walls 28 of the fully programmable housing body 16 are vertically aligned with solid-wall portions 30 of the cover 12 that extend between adjacent openings 14 thereof. Any means for supporting the shorting clips while allowing the pivoting of the legs thereof other than the ribs 26 may be employed without departing from the inventive concept. Cavities generally designated 27 are provided by the included wall portions of the walls 28 between longitudinally adjacent ribs 26 that receive the legs of shorting clips to be described as well a receive sockets to be described of the electrodes 18.

Shorting clips generally designated 32 are received through the open top of the fully programmable housing body 16 and are positioned on and supported by selected pairs of the confronting ribs 26 as best seen in FIG. 4. The shorting clips 32 are each of a generally U-shaped electrically-conductive material having two opposed legs 34 joined by resilient bridges 36, wherein each leg 34 includes at least one contact edge 38 located along the foot 40 thereof and a non-conductive protuberance 42, and wherein the space defined between the contact edges of the feet of the legs correspond to the longitudinal width of the solid wall portion 30 of the cover 12, also as best seen in FIG. 4. Reference may be had to, commonly-assigned U.S. Pat. No. 5,071,362 entitled Self-Operative Electrical Shunting Contact and Method for Forming, which is incorporated herein by reference, for a description of the preferred methods for manufacturing the shorting clips and for a description of alternative embodiments thereof. It should be noted that the number and placement of the shorting clips in FIG. 2 is exemplary only, and that any number and any arrangement of such clips may be implemented to satisfy the requirements of a particular application. In the presently preferred embodiment, plural, spaced apart walls defining vertically extending contact receiving cavities generally designated 44 are provided in the fully programmable housing body that individually are aligned with another opening 14 of the cover member 12, and that taken pairwise are each longitudinally to either side of another pair of confronting ribs 26 to implement the function of receiving, through the bottom surface of the housing 16, the contacts 18 in such a manner as to both align the contacts 18 with the openings 14 of the cover 14 and to support longitudinally-adjacent pairs of contacts 18 in position to b electrically-shorted when such pairs have been selected to be electrically-shorted by corresponding one or more shorting clips.

Figure 5:
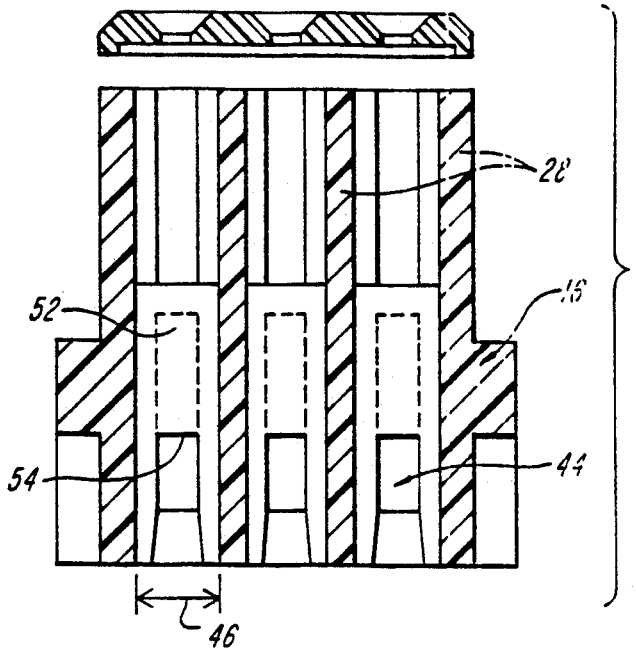
FIG. 5 is a transverse section along the lines 5—5 of FIG. 2 shown with the cover exploded from the housing body and with the cells empty of shorting clips and contacts.
Figure 7:
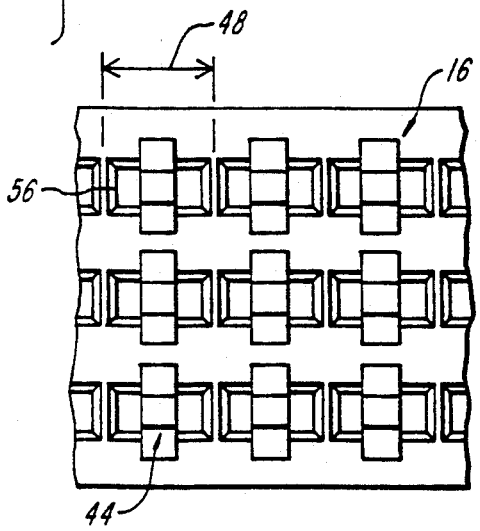
FIG. 7 is a partial bottom plan of the bottom face of a fully programmable DIN connector constructed in accord with the present invention.
Figure 6:
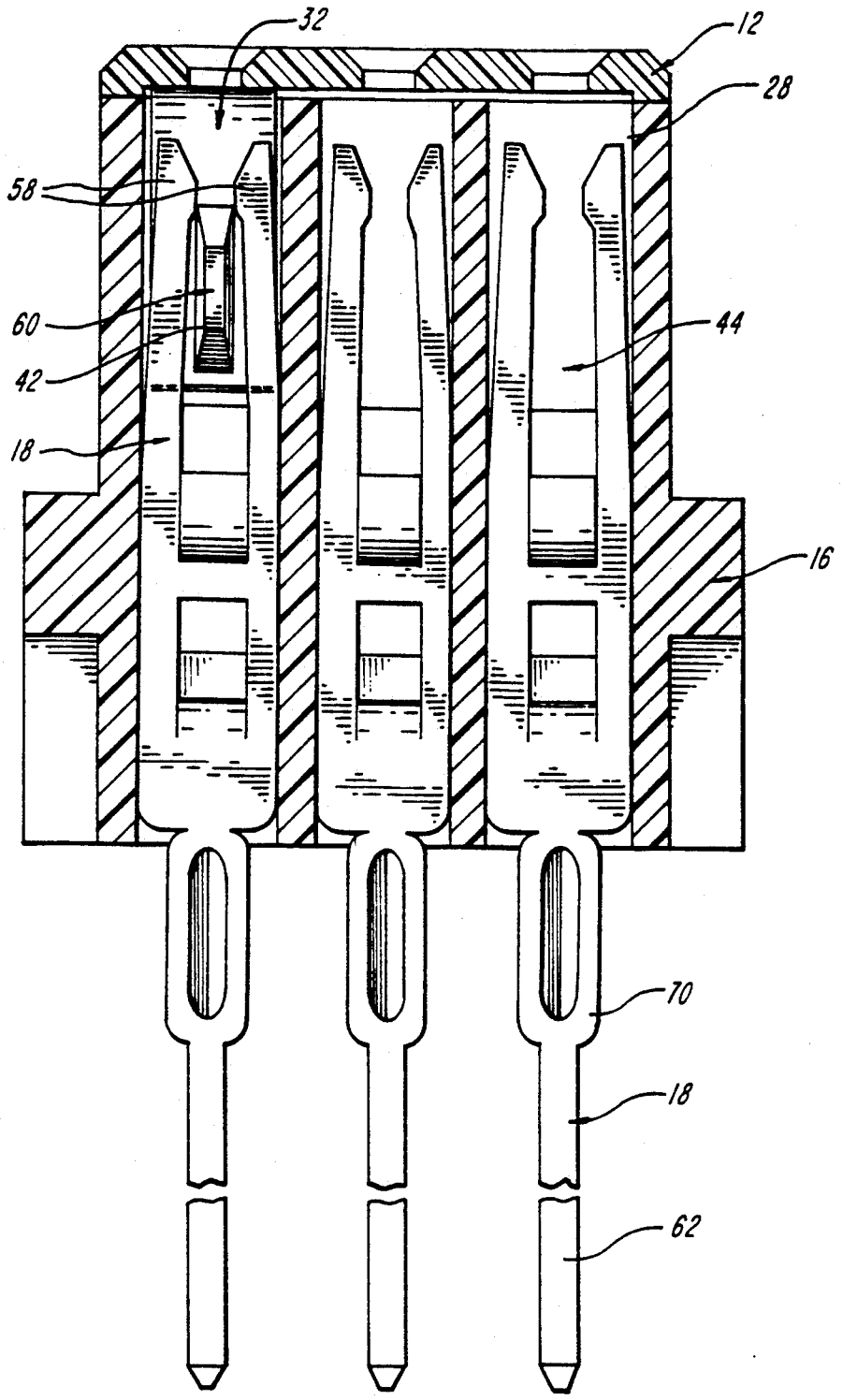
FIG. 6 likewise is a transverse section but shown with the cover in bonded relation to the housing body and with shorting clips selectively loaded into and with contacts loaded into the fully programmable cells of the housing body.

Each of the contact receiving and supporting cavities 44 of the housing body 16 has a transverse width as designated by an arrow 46 (FIG. 5) that is defined by the inside distance between confronting pairs of walls 28 as best seen in FIGS. 5 and 6, and has a longitudinal width as designated by an arrow 48 that is slightly larger than the outside distance between seating tangs to be described of the contacts 18 as best seen in FIG. 7. The walls of each of the cavities 44 vertically extend from the bottom surface of the housing 16 and open into a corresponding on of the shorting clip leg-receiving cavities 27 defined to either side of each shorting clip supporting rib 26, and have vertically-spaced and longitudinally-aligned shoulders 52, 54 which define anti-rotation stops for the seating tangs of the several contacts 18 as best seen in FIGS. 3 and 4. Preferably, the mouth of each of the cavities 44 proximate the bottom face of the housing 16 is beveled as at 56 to facilitate insertion of corresponding contacts 18 thereinto as best seen in FIGS. 3 and 4.

The contacts 18 each have twin fingers 58 confronting each other on one end to provide a socket generally designated at 60 into which a pin of a mating connector, not shown, is insertable, and each have depending electrode tails 62 on their other ends that provide a pin that is received by the socket of a mating connector, not shown, or by a printed circuit board or other interconnection device, not shown.

Between each pair of confronting fingers 58 and each electrode tail 62 is a box-beam generally designated 64. To stabilize each contact 18 against transverse twisting when seated in their corresponding cavity 44, the width of each box-beam 64 is selected to match that of the transverse width of the cavities 44. Preferably, the transverse width of the sockets 60 is selected to decrease towards their free-ends by an amount that facilitates the bottom loadability of the sockets 18 as best seen in FIG. 6.

To stabilize each contact 18 against longitudinal twisting when seated in their corresponding cavity 44, vertically-offset and outwardly projecting seating tangs 66, 68 thereof seat against corresponding ones of the vertically-spaced shoulders 52, 54 of each of the cavities 44 as best seen in FIG. 4.

Intermediate the box-beam 64 and the electrode tails 62 is an integral leaf-spring 70 whose resilience holds the pin 62 of the corresponding contacts 18 securely when it is pressed in its mating interconnection device, not shown.

Modifications to the contacts 18, and corresponding modifications to their corresponding mating connectors, are possible without departing from the inventive concept, so long as the contacts employed have socket and pin ends, and so long as the same are able to be securely retained precisely in position in the housing body 16 by suitable seating and securing means. Reference may be had to the above-incorporated United States patent application for a description of the contacts therein shown and described.

Referring again to FIG. 2, simply by inserting one or more shorting clips 32 onto one or more shorting clip receiving ribs 26, the ten (10) shorting clips 32 being merely illustrative of one possible configuration, the same programmable body 16 may be programmed to enable any one or more selected pairs of contacts 18 18 that are located longitudinally to either side of the one or more shorting clips to be nominally shorted in the absence of a pin being plugged into either of the sockets of any such pair of contacts. For any such selected configuration, as best seen in FIG. 4, the contact edges 38 of the feet 40 of the one or more shorting clips 32 are effectively supported by the ribs 26. Each contact 18 in longitudinally adjacent sockets 60 is electrically shorted by the shorting clips 32 via the circuit path provided by the corresponding bridge 36, as best seen in FIGS. 4 and 6. The insulative protuberances 42 of the one or more shorting clips 32 freely extends through the interspace 62 defined between the corresponding fingers 58 of the sockets 60 of the longitudinally adjacent contacts 18.

Shorting clips 32 may be inserted into any selected one or more cells of the housing body to program the connector to the particular application. To program the connector for a selected configuration, a template, not shown, having an opening pattern that conforms to the particular cell(s) of the housing 16 selected to receive shorting clip(s) 32 may be employed. Once inserted, the one or more shorting clips, that rest on the ribs 26, whenever the connector is programmed, are constrained against twisting thereon by abutment of their lateral edges with the confronting surfaces of the walls 28. The same housing 16 may be readily programmed for any selected configuration of shorting clips.

Thereafter, the cover 12 is bonded to the housing body 16, as by ultrasonically welding posts 72 upstanding on top of the housing body 16 into the apertures 28 provided therefor in the cover as seen in FIG. 2. Other techniques such as heat-staking, well-known to those skilled in the art, may be employed as well to bond the cover 12 to the housing body 16.

Figure 8:
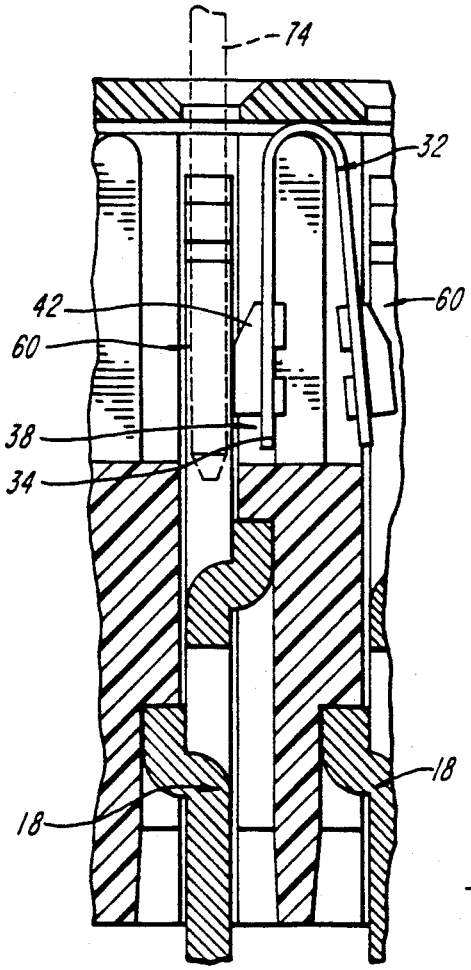
FIG. 8 is a partial longitudinal section illustrating a pin received within a socket of a contact of a cell of the housing body 16 of the fully programmable DIN connector constructed in accord with the present invention.

As best seen in FIG. 8, a pin of mating male connector, shown as dashed lines at 74, is inserted into any socket 60, that is normally shorted with the socket 60 of a longitudinally adjacent contact 18 by means of the intermediate shorting clip. The pin 74 contacts the insulative protuberance 42 of the shorting clip 32 and the corresponding leg 34 pivots in such a way that the contact edge 38 thereof is moved out of mechanical and electrical contact with the socket 60 into which the pin is inserted. With the removal of the pin the leg resiliently pivots back and re-establishes the electrical-shorting relation between adjacent sockets, before pin 74 breaks contact with contact 18.

Figure 9:
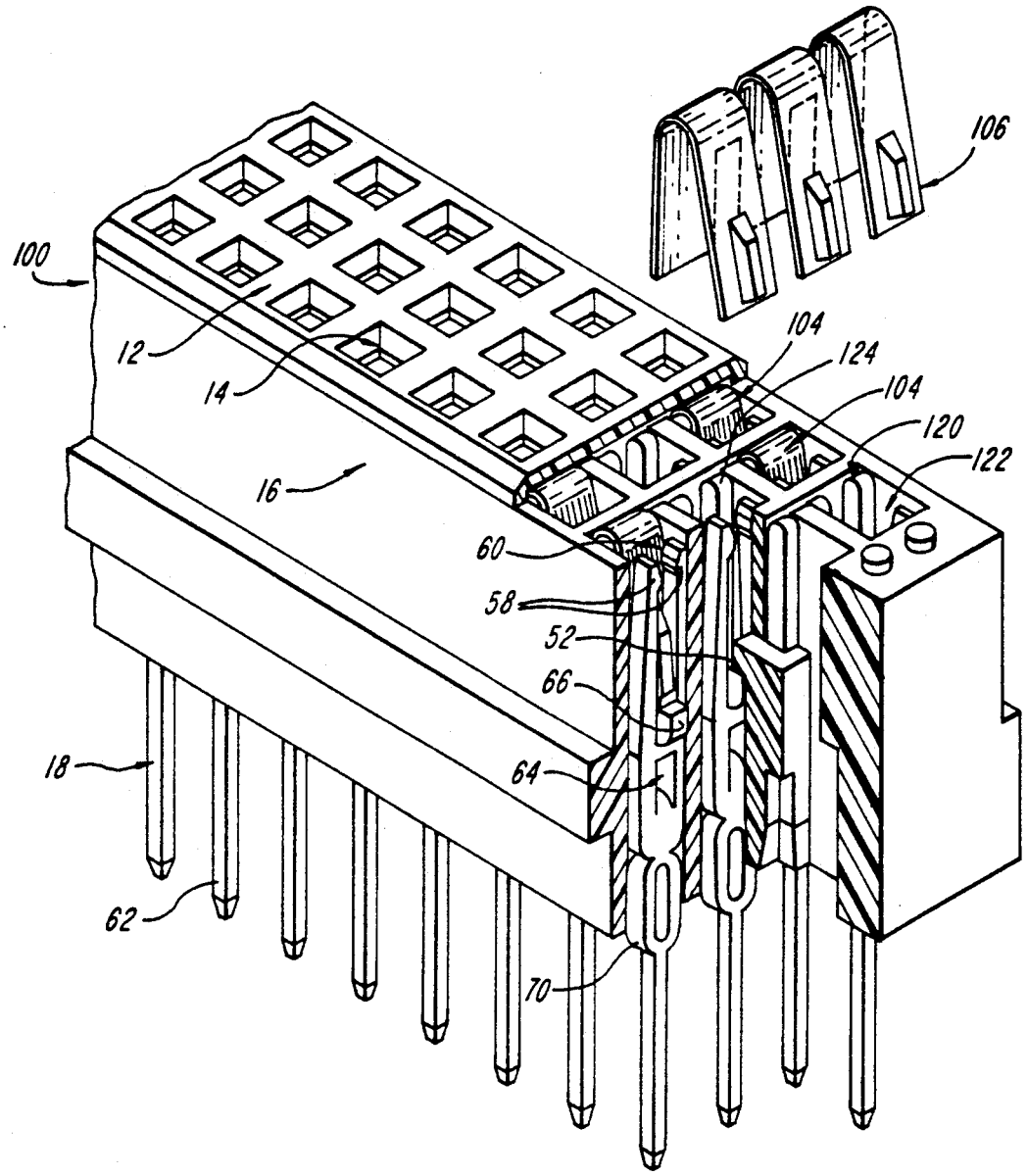
FIG. 9 is a perspective view of a portion of another embodiment of a connector constructed in accord with the present invention.

Referring now to FIG. 9, generally designated at 100 is an alternative embodiment of the fully programmable DIN connector in accord with the present invention. The connector 100 differs from that described hereinabove in that it enables the provision of transverse connection between two or more transversely adjacent sockets whereas the embodiment described hereinabove provides connection of longitudinally adjacent sockets. The embodiment 100 like the embodiment described heretofore has a cover member generally designated 12 having an array of openings generally designated 14 thereinthrough, a fully programmable housing body generally designated 16, and a plurality of bottom loadable 16 contacts generally designated 18. The openings 14 of the cover 12 and the contacts 18 bottom loadable into the housing body 16 define an exemplary three (3) by seventeen (17) DIN connector array, although, as will be appreciated by those skilled in the art, that other DIN and other array configurations than that specifically illustrated are contemplated. The contacts or sockets 18 and the walls of the housing body 16 that receive the contacts 18 are of identical construction as that of the fully-programmable connector embodiment described hereinabove, and the same members in the embodiment 100 and in the embodiment described heretofore bear like reference numbers.

Figure 10A:
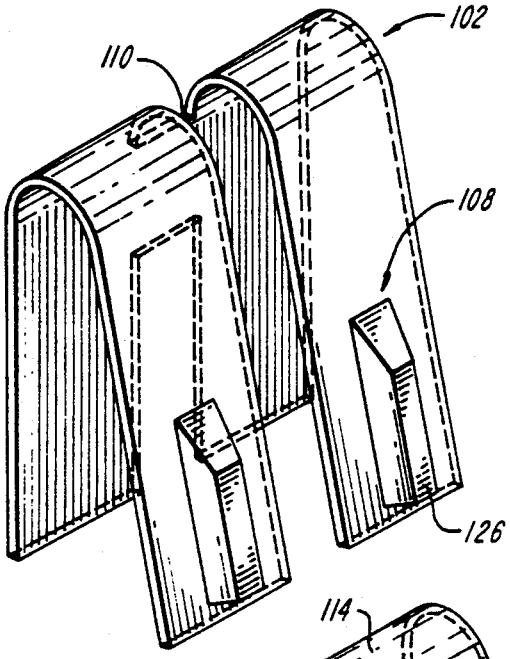
FIG. 10 illustrates in the FIGS. 10A, 10B and 10C thereof perspective views of shorting clips for the embodiment of FIG. 9 in accord with the present invention.
Figure 10B:
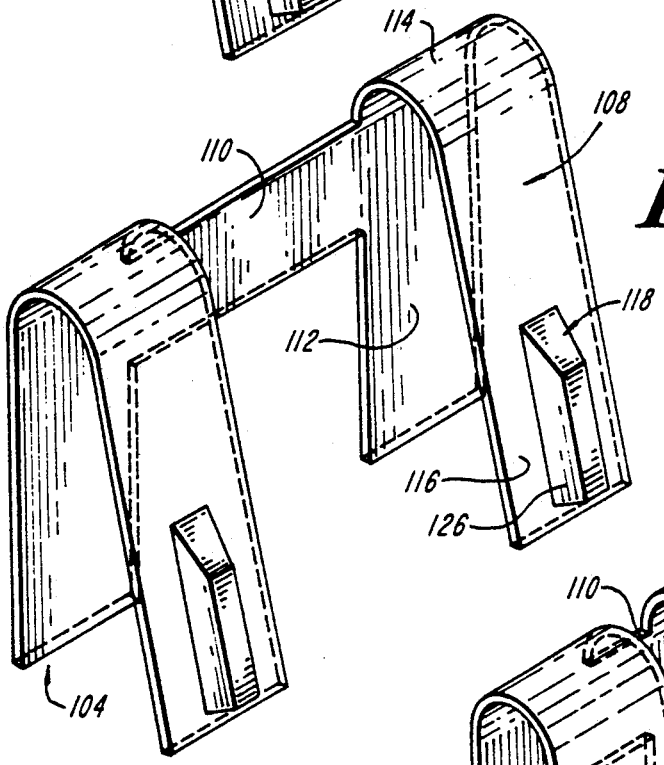
Figure 10C:
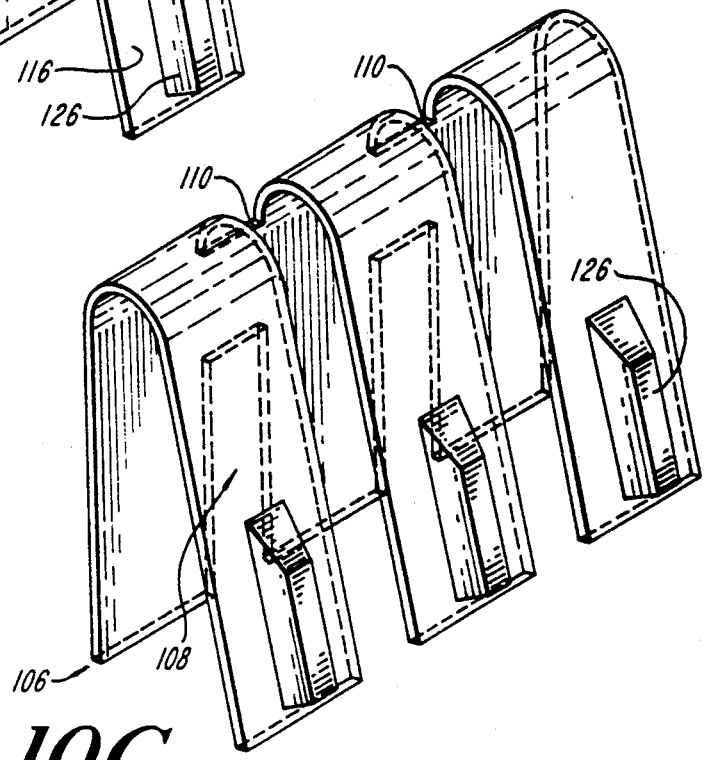

For the exemplary three-row connector 100 of FIG. 9, self-seating shorting clips generally designated 102 in FIG. 10A, 104 in FIG. 10B and generally designated 106 in FIG. 10C are provided that enable the selective shorting of two or more mutually transversely disposed sockets 1. The self-seating shorting clip 102 of FIG. 10A enables the shorting of any two transversely adjacent sockets 18, either a socket located in either of the outside longitudinal rows and a socket located in the middle row of the exemplary three-row connector. The shorting clip 104 of FIG. 10B enables shorting of transversely spaced sockets located in any of the transversely disposed outer rows, but not the inner row. Thus the contact in the inner row is bridged by the shorting clip in this version and is not shorted. The self-seating shorting clip 106 of FIG. 10C enables the electrical connection of the sockets transversely across all three rows of the exemplary three-row connector.

In FIG. 9, there is shown shorting clips 104 connecting the 16 contacts 18 in the outer rows, but not the intermediate contact in the middle row. Also shown are shorting clips 106 which connect all three contacts 18 across the three rows. It is contemplated 19 that other configurations of shorting clips and cooperative housing cells can be provided in accordance with the invention to selectively connect any two or more contacts of the connector. The contacts can be immediately adjacent to one another or separated by one or more other contacts that are bridged and not connected by the clip.

Figure 12:
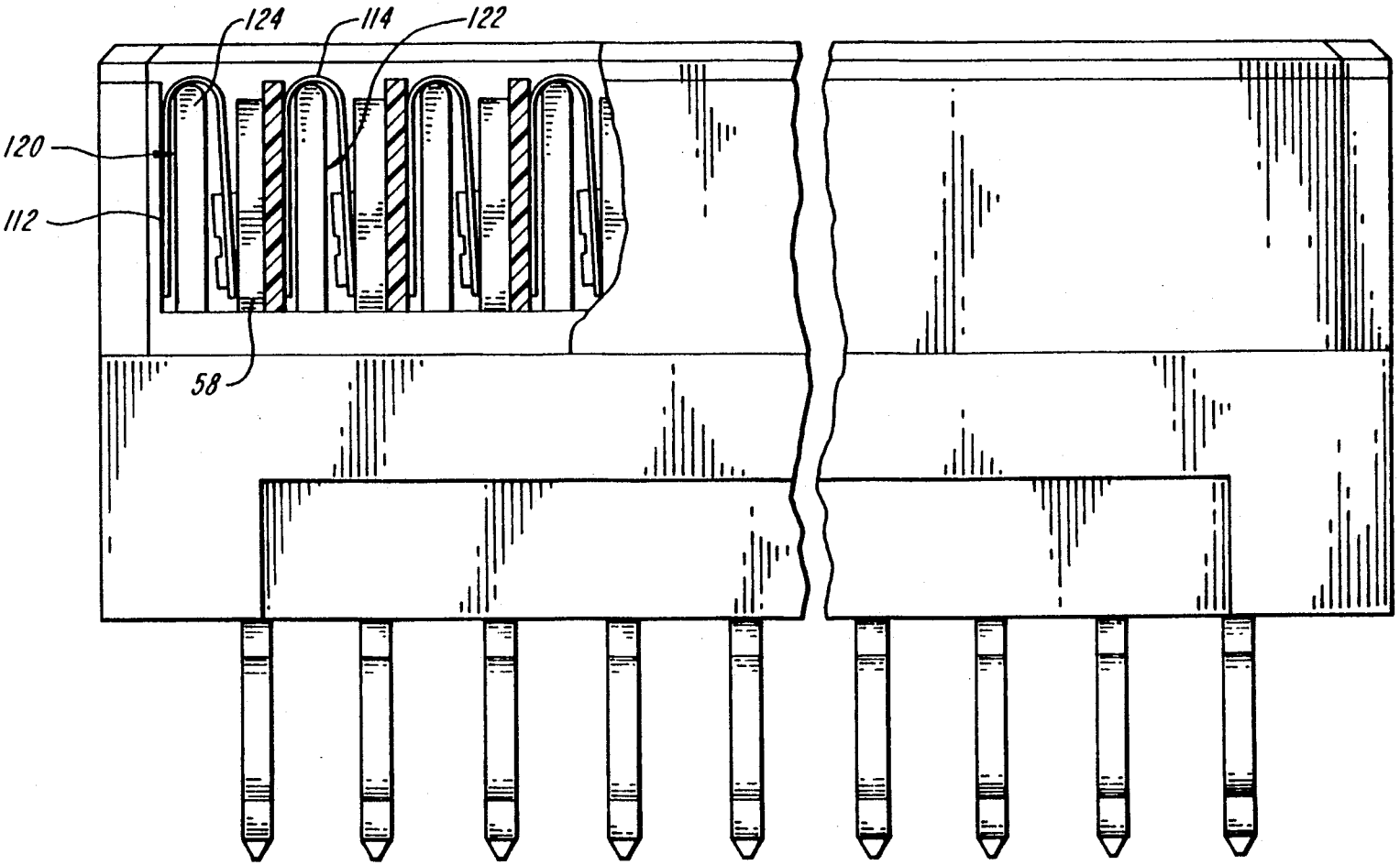
FIG. 12 is a side elevational view with the housing body partially broken away of the connector of the alternative embodiment in accord with the present invention.

The self-seating shorting clips 102, 104 and 106 (FIG. 10) of the connector 100 each have two or more clip portions generally designated 108 and a tie bar 110 interconnecting transversely-adjacent clip portions 108. The clip portions 108 each are constituted by an anchor leg 112, a web 114, an active beam resilient leg 116 and an insulative protuberance generally designated 118 fastened to the active beam resilient leg 116. The anchor portion 112 of the clips are received in a channel generally designated 120, best seen in FIG. 12, that is as long as each of the anchor portions is long and that is wider than the width of the corresponding web portion of the clip portions of the several self-seating shorting clips. These channels 120 are preferably formed 10 as cavities by the walls of the housing portion 16 in each of the cells of the connector 100. The active beam resilient leg portions 108 of corresponding self-seating shorting clips is received in corresponding cavities generally designated 122, best seen in FIG. 12. The length of the cavities 122 is longer than the length of the corresponding active beam resilient leg and the width is 16 slightly larger than the width of the corresponding web 114 of the clip portion 108 of the self-seating shorting clips.

Figure 11:
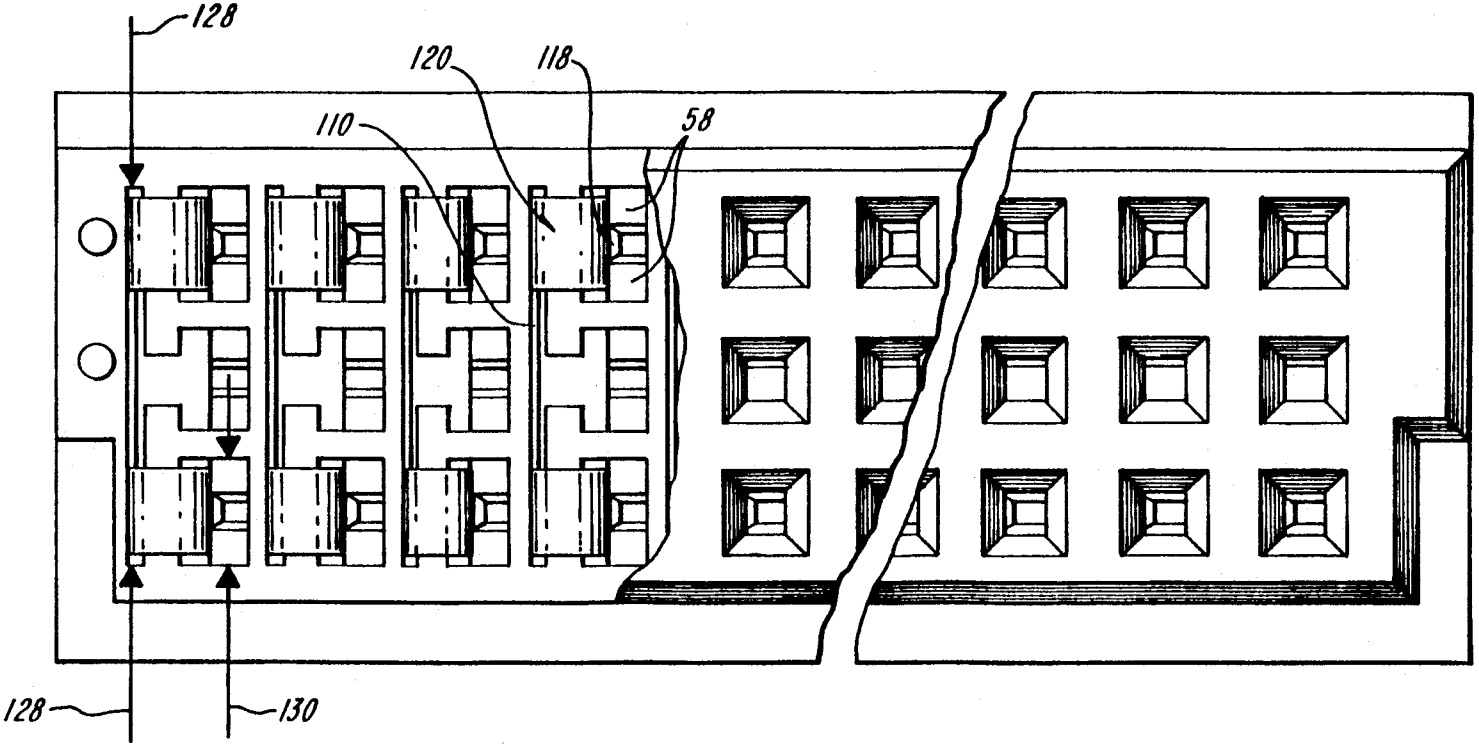
FIG. 11 is a top plan view with the cover partially broken away of the connector of the alternative embodiment in accord with the present invention.

The cavities 122 are provided by interior walls in each of the cells of the housing body 16 of the connector 100. The webs 114 of the corresponding clips 108 of the self-seating shorting clips of FIG. 10 are seated against preferably rounded-top seats or anchors 124 that are formed in each of the fully-programmable cells of the housing body 16. The seats 124 are offset from the center of the corresponding cells and enable thereby the corresponding clip portion 108 of the self-seating shorting clips of FIG. 10 to be received in the cell so that the anchor portion 112 thereof is received in the channel 120, with the active beam resilient leg portion 116 thereof in the cavities 122 extending between the tuning fork contacts 58 and aligned with another opening 14 of the cover 12, as best seen in FIG. 11 The upper portions of the walls defining each of the cells are broken away to provide a transversely-extending channel between transversely-adjacent cells to receive the tie-bars 110 of the several clips 102, 104 and 106 of FIG. 10.

Any suitable means ma be provided to keep the shorting clips from jamming with the tuning fork contacts of the several contacts. In the preferred embodiment, a self-seating action is provided preferably by beveling the sides of the insulative protuberances 118 as designated 126 in FIG. 10, so that the abutment of the insulative protuberances with the corresponding walls of the tuning fork contacts 58 of the sockets 18 tends to seat them centrally therebetween. Self-seating action is also provided preferably by making the transverse dimension defined by the walls between which the transverse shorting clips are received, illustrated by arrow generally designated 128, larger than the transverse width of the several shorting clips of FIG. 10. Additionally, the transverse dimension defined by the walls of the channels that receive the active beam resilient leg portions, illustrated by arrow generally designated 130, are made to be wider than the transverse width of the corresponding web and active beam resilient leg portion of the several clips, as best seen in FIG. 11. The side tapers on the insulative protuberances cooperate with the smaller-size of the web of the several contacts and of the smaller-size of the transverse width of the several contacts to provide play-room in which self-seating action occurs. The cover can be provided with slots, not shown, that confront the corresponding web portions of the self-seating shorting-clips that allow the clips to move up and down. Mounting flanges, not shown, may be provided to longitudinally opposing bottom edges of the housing body 16 to facilitate mounting. The underside of the housing body 16 may =provided with a channel, not shown, for solder reflow purposes.

The normal force of the active beam resilient leg of any of the self-seating shorting clips enables the corresponding tuning fork portions of the several sockets to be mechanically contacted and electrically connected through the corresponding tie bar portions of the corresponding one or more tie bar portions 110 of the several self-seating shorting clips 102, 104 and 106 of FIG. 10. A pin inserted through an opening in the cover that has a 15 shorting clip providing transverse electrical connection as in the embodiment of FIGS. 1 through 8, contacts the insulative protuberance and pushes it towards the anchor portion 112 thereof. As it is pushed away, the active beam resilient leg portion 116 breaks electrical contact with the corresponding tuning fork portions of the socket. Thereby, the normally shorted sockets are electrically unshorted. The tuning fork makes contact before the shorting clip breaks contact, and vice versa, the shorting clip makes before the tuning fork breaks.

The invention can also be embodied to provide selective shorting of contacts along a row which are not immediately adjacent as in the embodiment of FIG. 9 for transverse connection across rows. For example, shorting clips similar to those of FIG. an be provided to connect two or more contacts in a row, which contacts can be spaced by one or more intermediate contacts in a row which are not shorted. Thus the invention provides a universal connector capable of providing in a single universal housing, selective shorting of two or more contacts.

Figure 13:
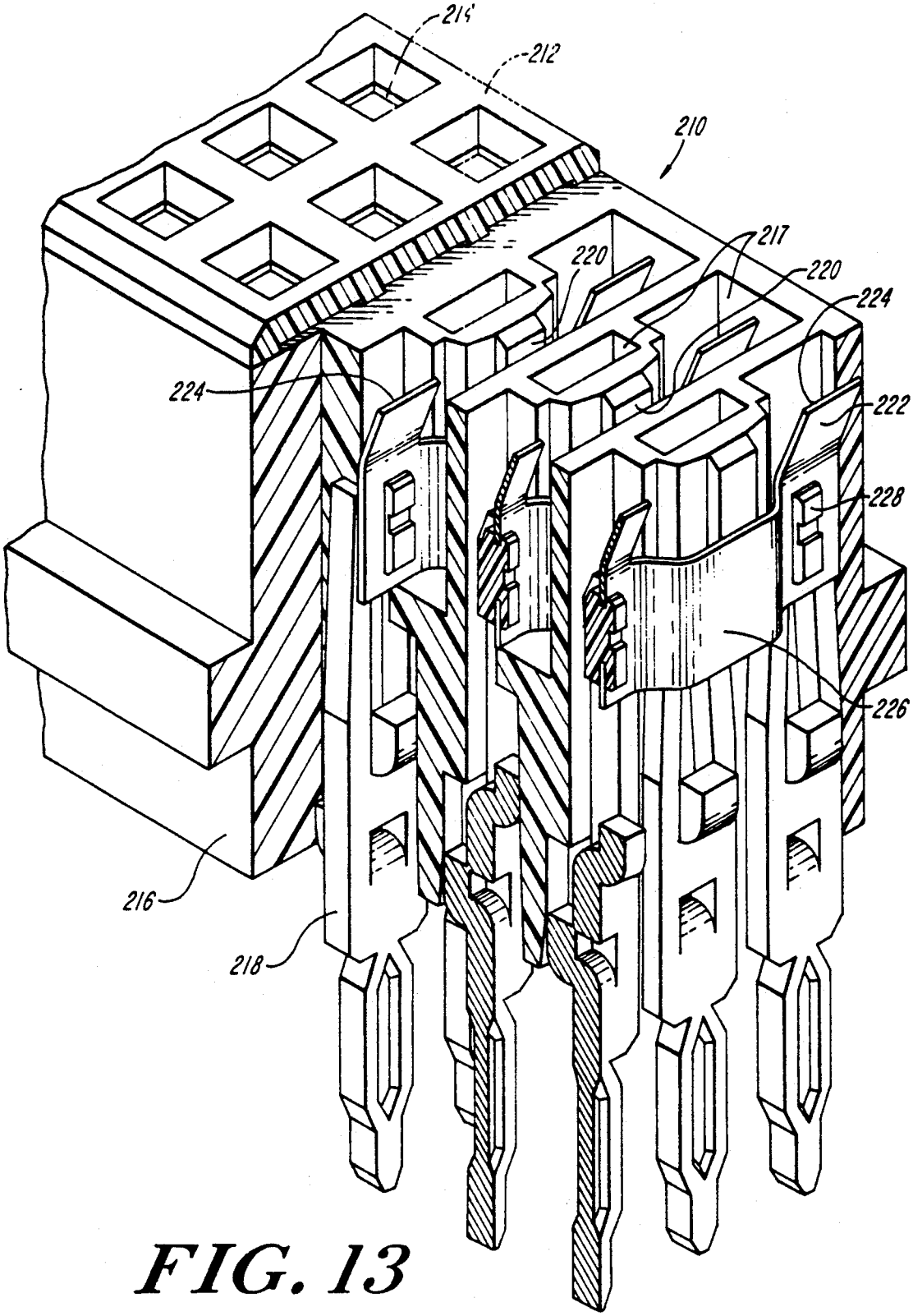
FIG. 13 is a perspective view partially in section, of still another alternative embodiment in accord with the present invention, wherein non-adjacent contacts in the same row are shunted.
Figure 14:
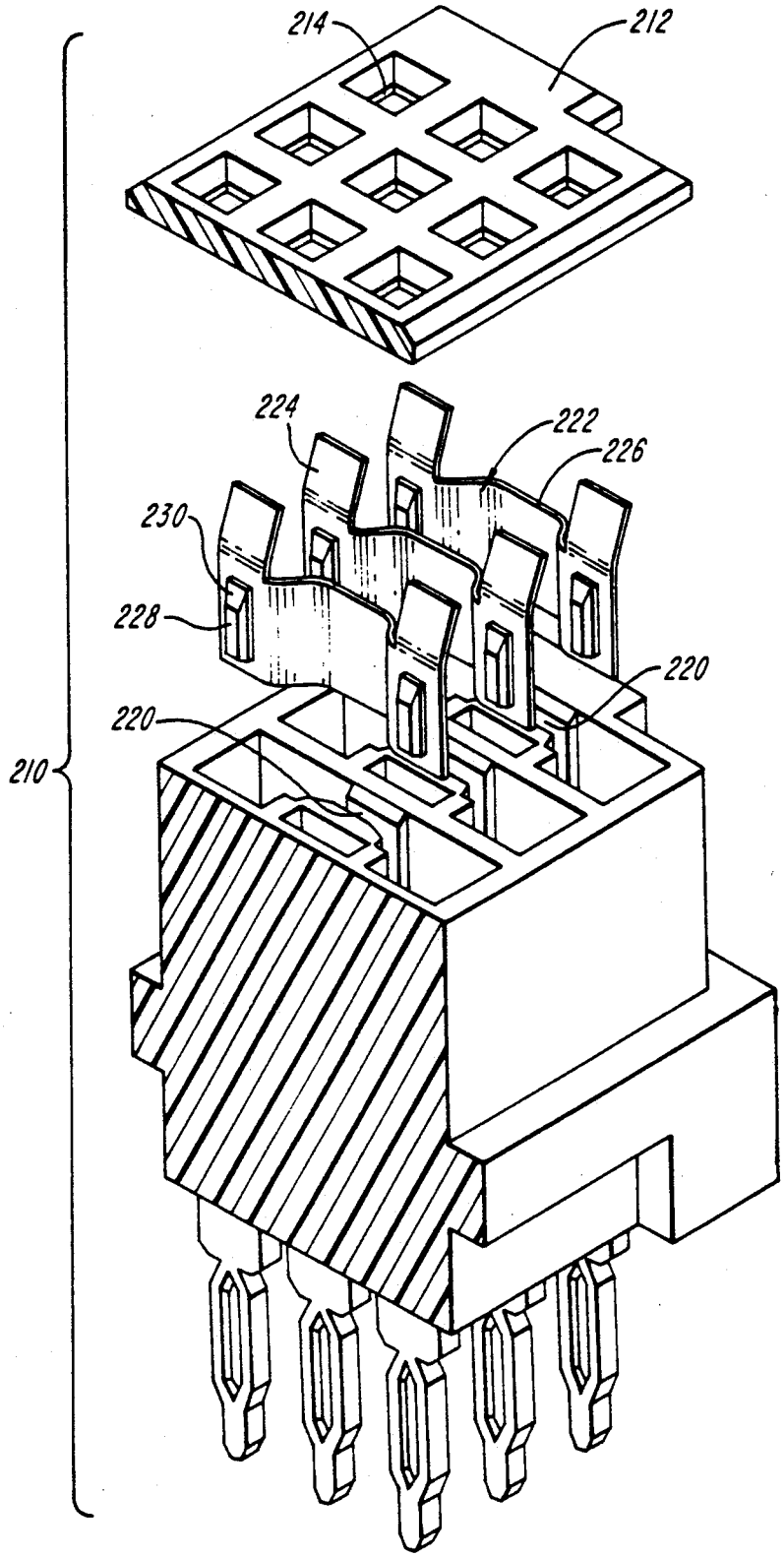
FIG. 14 is an exploded perspective view of the alternative embodiment of FIG. 13.

Referring now to FIG. 13 and 14, alternative embodiments of a connector and shorting clips according to the invention are shown. As illustrated, a connector 210 includes a separable cover 212 having an array of openings 214 therethrough. A fully programmable housing body 216 includes a plurality of cavities 217 (substantially similar to those illustrated in FIG. 2), disposed in rows. Each cavity is configured to receive a respective one of a plurality of contacts 218. In this exemplary embodiment, a three (3) row by N column connector array is formed wherein it is desirable and feasible to shunt or short together a plurality of non-contiguous, non-adjacent contacts 218.

The housing body 216, in addition to the plurality of cavities 217 each configured to receive a respective one of a plurality of bottom loadable contacts 218, includes a channel 220 in each row of cavities 217. The channel extends between extreme outermost cavities and is configured to receive a portion of a row shorting clip 222.

The row shorting clips 222, as illustrated in the embodiment of FIGS. 13 and 14, are stamped metallic members having a plurality of contact surfaces 224 and a bridging portion 226 disposed therebetween. Each of the plurality of contact surfaces 224 has a respective one of a plurality of non-conductive protuberances 228 disposed proximate thereto.

The row shorting clips 222 are configured so that the contact surfaces fit within the cavities 217 of the housing body 216 while the bridging portion 226 is disposed within the channel 220 thereof. The row shorting clips 222 are bent so that when the clips 222 are so disposed within the housing body 216, along with contacts 218, the contact surfaces 224 of the clips 222 engage the respective contact(s) 218 establishing electrical continuity, i.e. shorting between the clip 222 and the respective contacts 218.

Each contact surface 224 of the clips 222 has an insulative portion or non-conductive protuberance 228 extending therefrom. The non-conductive protuberance 228 is dimensioned to fit between prongs in the contacts 218 to permit the contact surface 22 of the clips 222 to engage the contact. The non-conductive protuberance has a beveled edge 230 (best seen in FIG. 14) which facilitates 16 slidable engagement with a male mating pin installed into the cavity 217. Upon insertion of such a pin, from a mating connector portion (not shown), the beveled edge 230 of the non-conductive protuberance is slidably engaged by the pin, which actuates the contact surfaces 224 away from the contacts 218 breaking continuity and the electrical short between the contacts in the row. The pin, fully inserted into the cavity is maintained in engagement with the respective contact 218 and the non-conductive protuberance rendering the row shorting clip 222 ineffectual.

Figure 16:
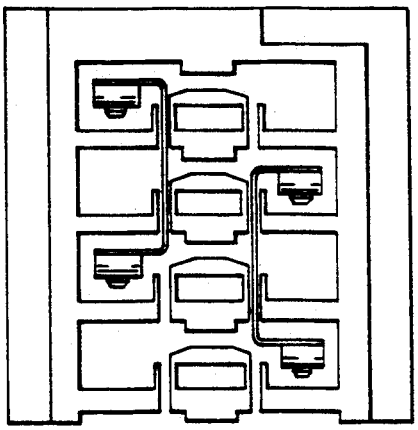
FIG. 16 is a top plan view of the embodiment of FIG. 15.
Figure 15:
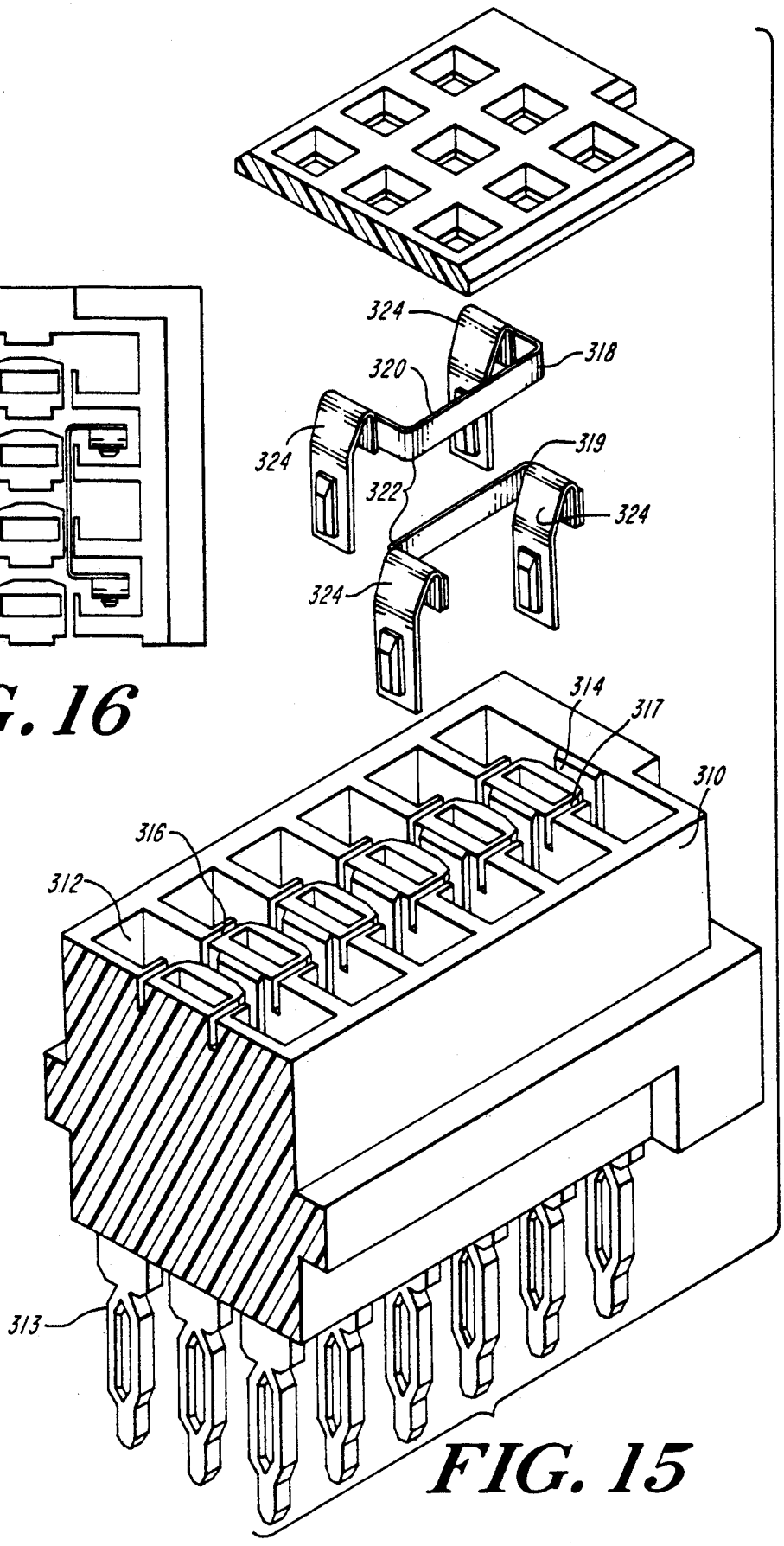
FIG. 15 is an exploded perspective view of still another alterative embodiment in accord with the present invention, wherein non-adjacent contacts in different rows are shunted.

Referring now to FIGS. 15 and 16, still other alternative embodiments of a connector and shorting clips according to the invention are shown. The connector illustrated includes a housing 310 having a plurality of cavities 312 disposed therein for receiving a respective plurality of contacts 313. In the embodiment shown, the cavities 312 are disposed as a 3 row by 6 column array, purely for illustrative purposes. The cavities 312 have row channels 314 effecting channels for receiving a bridging portion (FIG. 13, 226), of a row shorting clip 222 as disclosed hereinbefore. The housing 310 further includes a plurality of column channels 316, 317 which run substantially the entire length of the housing 310 along the columns of cavities 312. The column channels 316, 317 are configured for receiving column shorting clips 318, 319 which permit the shorting of selected ones of the plurality of contacts 313 disposed within cavities 312 along a column.

The column shorting clips 318, 319 are metallic members 320 having 90° bend portions 322 from which extend resilient contact portions 324. The metallic members 320 are dimensioned to fit within the column channels 316, 317 and the resilient contact portions 324 are dimensioned to fit within respective ones of the plurality of cavities 312. Insulative protrusions 326 extend outwardly from the resilient contact portions 324 and function substantially like the non-conductive protuberances (228) discussed hereinbefore. A center-left column shorting clip 318 has the resilient contact portions 324 to the left of the metallic member 320 when looking at the beveled portion of the insulative protrusions 326. The center-left column shorting clip 318 is useful for shorting non-contiguous, non-adjacent contacts within the center and left of center column of cavities when the metallic member 320 is installed in either column channel 316, 317. A center-right column shorting clip 319 has resilient contact portions 324 to the right of the metallic member 320 when looking at the beveled portion of the insulative protrusions 326. The center-right column shorting clip 319 is useful for shorting non-contiguous, non-adjacent contacts within the center and right of center column of cavities when the metallic member 320 is installed in either column channel 316, 317.

While the embodiment of FIGS. 15 and 16 illustrates an array wherein two column channels are implemented, it will be appreciated that larger arrays can be implemented wherein a greater plurality of column channels and row channels are implemented.

Although row shorting clips are disclosed herein which are configured to normally engage contacts and require pin intervention to actuate the shorting clip to break such contact, it will be appreciated that the row shorting contacts can be configured so that the pin intervention actuates the contact to break the shunt.

Further, while the row shorting clips are described as a "stamped metallic member", it will be appreciated that the clips can be made of alternative materials and methodologies, such as by molded or extruded plastic with appropriately located metallic/conductive elements.

While connectors are illustrated and disclosed herein having 3 row by 6 or N column arrays of cavities, it will be appreciated that single row or column connectors, or connectors of various formats can be implemented according to the invention.

Although "bottom-loadable" contacts are described in the illustrative embodiments herein, it will be appreciated that the contacts can be top loadable or otherwise installable into the connector(s).

Additionally, although contacts are described and illustrated herein as having tuning fork-like prongs through which non-conductive protuberances extend during contact/shorting clip engagement, it will be appreciated that numerous contact configurations can be implemented to accommodate such a protuberance or extension of various types.

Many modifications, such as the fact that the invention is useful in any multi-position or multi-contact connector in which one or more shorting clips are to be installed, will become apparent to those skilled in the art having benefitted by the disclosure of the instant invention.

Although the invention has been shown and described with respect to exemplary embodiments thereof, various other changes, omissions and additions in form and detail thereof may be made therein without departing from the spirit and scope of the invention.

What is claimed is:

1. A fully programmable connector receiving shorting clips that provide electrical interconnection between selected two or more contacts, comprising:

at least two contacts;

at least one shorting clip configured to electrically engage said at least two contacts;

a housing having a top face and a bottom face and a plurality of cells terminating in respective openings through at least one of the top face and the bottom face of the housing through which pins of a mating connector are received;

at least some of said plurality of cells receiving and retaining a respective said contact, said housing including at least one first channel receiving a portion of said at least one shorting clip and supporting said shorting clip within said housing in position to electrically short-circuit selected ones of said at least two contacts.

2. The connector of claim 1 wherein the shorting clip is disposed to short contacts aligned in an adjacent pair of cells.

3. The connector of claim 1 wherein the connector is a multiple row connector and the shorting clip is disposed to short contacts aligned in adjacent cells of a single row to electrically connect at least two contacts of the row.

4. The connector of claim 1 wherein the connector is a multi-row connector and wherein the shorting clip is disposed to short contacts in adjacent cells of multiple rows to electrically connect at least two contacts of the multiple rows.

5. The connector of claim 1, wherein said housing is comprised of transversely-spaced, longitudinally-extending and generally-planar vertical walls, and wherein said at least one first channel includes vertically extending shorting clip supporting members formed in longitudinally-spaced relation along said transversely-spaced, longitudinally-extending and generally-planar vertical walls of said housing.

6. The connector of claim 5, wherein said shorting clip supporting members are confronting pairs of ribs.

7. The connector of claim 6, wherein said ribs have rounded-tops.

8. The connector of claim 1, wherein said housing further includes at least one second channel formed by plural, spaced apart walls defining contact shorting clip receiving cavities that are substantially orthogonally disposed with respect to said at least one first channel.

9. The connector of claim 5, wherein said shorting clip supporting members are formed by transversely spaced confronting ribs.

10. The connector of claim 1, wherein said connector is a DIN connector.

11. The connector of claim 1, wherein each of said at least one shorting clip comprises at least two clip portions and an interconnecting bridging portion.

* * * * *

UNITED STATES PATENT AND TRADEMARK OFFICE

CERTIFICATE OF CORRECTION

PATENT NO. : 5,277,606

DATED : January 11, 1994

INVENTOR(S) : David C. Giroux, et al

It is certified that error appears in the above-indentified patent and that said Letters Patent is hereby corrected as shown below:

Column 1, lines 46-47, "needed to = manufactured" should read --needed to be manufactured--.

Column 3, line 22, "contacts 1 bottom" should read --contacts 18 bottom--.

Column 3, line 47, "receive 16 through" should read --receive through--.

Column 3, line 61, "on or more" should read --one or more--.

Column 4, line 54, "corresponding on of" should read --corresponding one of--.

Column 5, line 41, "contacts 18 18" should read --contacts 18--.

Column 7, line 50, "means ma be" should read --means may be--.

Column 8, line 13, "= provided" should read --be provided--.

Column 8, line 23, "a 15 shorting clip" should read --a shorting clip--.

UNITED STATES PATENT AND TRADEMARK OFFICE

CERTIFICATE OF CORRECTION

PATENT NO. : 5,277,606

DATED : Jan. 11, 1994

INVENTOR(S) : David C. Giroux, et al

It is certified that error appears in the above-indentified patent and that said Letters Patent is hereby corrected as shown below:

Column 8, line 38, "of FIG. an" should read --of FIG. 10 can--.

Signed and Sealed this

Sixth Day of September, 1994

*Attest:*

*Attesting Officer*

BRUCE LEHMAN

*Commissioner of Patents and Trademarks*